US005320159A

United States Patent [19]

Schneider et al.

[11] Patent Number: 5,320,159

[45] Date of Patent: Jun. 14, 1994

[54] CONTINUOUS CASTING APPARATUS HAVING GAS AND MOLD RELEASE AGENT SUPPLY AND DISTRIBUTION PLATE

[75] Inventors: Wolfgang Schneider, Augustin; Manfred Langen, Bonn, both of Fed. Rep. of Germany

[73] Assignee: VAW Aluminum AG, Bonn, Fed. Rep. of Germany

[21] Appl. No.: 47,650

[22] Filed: Apr. 13, 1993

[30] Foreign Application Priority Data

Apr. 15, 1992 [DE] Fed. Rep. of Germany ..... 4212531

[51] Int. Cl.[5] ..... B22D 11/07

[52] U.S. Cl. ..... 164/268; 164/444; 164/472

[58] Field of Search ..... 164/268, 444, 472, 487

[56] References Cited

U.S. PATENT DOCUMENTS

| | | | |
|---|---|---|---|
| 3,286,309 | 11/1966 | Brondyke et al. | 164/472 X |
| 3,381,741 | 5/1968 | Gardner | 164/472 |
| 3,446,267 | 5/1969 | Gricol et al. | 164/268 |
| 4,103,732 | 8/1978 | Habert | 164/472 X |
| 4,157,728 | 6/1979 | Mitamura et al. | 164/472 X |
| 4,709,744 | 12/1987 | Bryson et al. | 164/472 |
| 5,170,838 | 12/1992 | Theler et al. | 164/452 |

FOREIGN PATENT DOCUMENTS

| | | | |
|---|---|---|---|
| 0167056 | 1/1986 | European Pat. Off. . | |
| 0218855 | 4/1987 | European Pat. Off. . | |
| 0372946 | 6/1990 | European Pat. Off. . | |
| 57-39061 | 3/1982 | Japan | 164/268 |
| 57-50250 | 3/1982 | Japan | 164/472 |
| 1-138043 | 5/1989 | Japan | 164/472 |
| 672755 | 12/1989 | Switzerland . | |
| 569376 | 8/1977 | U.S.S.R. | 164/472 |
| 2129344A | 5/1984 | United Kingdom . | |

*Primary Examiner*—J Reed Batten, Jr.
*Attorney, Agent, or Firm*—Perman & Green

[57] ABSTRACT

Mold apparatus for continuous casting of metal, has an intermediate plate for supplying one or more mold release agents to the surface of the billet or ingot forming in a cooled mold. The intermediate plate has outlet openings which terminate in an intermediate area between a hot top section and a mold section in which the molten metal solidifies. The intermediate release agent supply plate having a central cross sectional opening is provided between the hot top section and the mold section, the surface of the central opening, adjoining the surfaces of the hot top section and the mold section. The intermediate plate comprises a flat plate having release agent-supply channels that extend to the opening edge and are precision-formed into the upper and lower surfaces of the intermediate plate to a constant depth. Liquid and/or gaseous mold release agents are fed through the supply plate to lubricate the mold surface along which the ingot is formed, cooled and lowered.

18 Claims, 6 Drawing Sheets

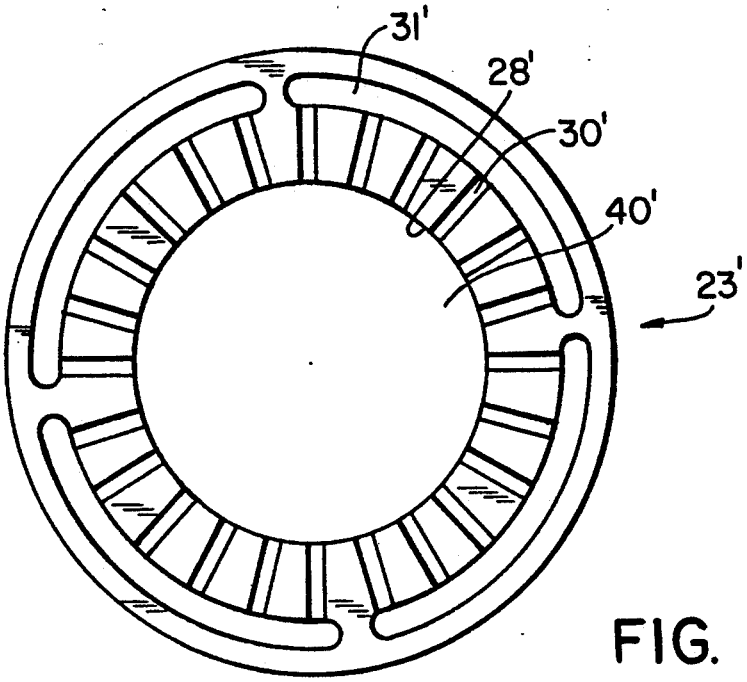
FIG. 5
FIG. 6
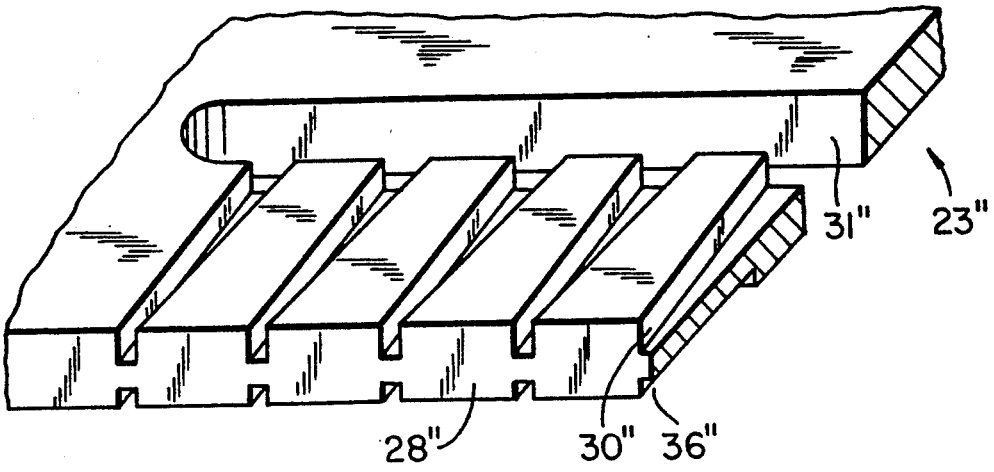

CONTINUOUS CASTING APPARATUS HAVING GAS AND MOLD RELEASE AGENT SUPPLY AND DISTRIBUTION PLATE

BACKGROUND OF THE INVENTION

The invention relates to an apparatus for continuous casting of molten metal, in which a mold release or parting agent or mixture is supplied to the surface of the casting being formed through supply channels which open into an intermediate area of the apparatus below the hot top section where the molten metal cools and hardens. An intermediate element having a central open cross section is provided between the hot top section and the mold section, and the surfaces of said element together with the adjacent surfaces of the hot top section and/or mold section constitute at least the end sections or openings of the supply channels that lead directly to the walls of the mold section. A shoulder or wall is present around the opening cross section in the casting direction, between the hot top and the water-cooled mold; the molten metal, which is still liquid in the vicinity of the hot top, enters this shoulder so that the molten bath essentially assumes the opening cross section of the mold. It is conventional to supply a parting or release agent or a mixture of such agents to the surface of the continuous casting being formed, so that direct contact with the surface of the mold is avoided. This is necessary for the casting to have good surface quality. This is particularly necessary when the continuous-cast products are to be plastically-shaped or molded during subsequent processing, without surface layers having to be removed mechanically beforehand. When the parting agent supply is insufficient or not uniformly regulated, depending on the boundary conditions, surface and edge structural defects can develop in the casting or ingot. These include, in particular, surface irregularities or inhomogeneities in the structure near the surface. Parting oils, especially mixtures thereof with gases such as air or inert gas, have been found to be suitable parting or release agents, and must be supplied under pressure, with a gas-oil mixture being formed by virtue of the pressure and temperature conditions prevailing in the mold.

DISCUSSION OF THE KNOWN ART

The basic problems discussed above are known. It is also known that the metering of the volumes of oil and gas must be precise, i.e. the supply must be regulated during the process and hence the corresponding supply pressures and supply rates must be capable of being regulated.

It is known from DE 33 38 184 C2 that a porous annular body can be provided in the mold wall in the transitional or intermediate area between the hot top section and the mold, with annular channels on the back of the body to supply parting oil and gas. The parting agents are supposed to mix with one another in the porous annular body and escape with metering to the casting.

The system of holes and annular channels provided in the mold is complicated. A suitable annular body which has radial holes and possibly circumferential grooves on its back is expensive, complicated, and unreliable in operation, since its porous structure can be clogged by thickened parting oil.

EP 0 218 855 B1 teaches a device of the aforementioned type in which the annular ducts are formed by annular grooves in an intermediate element and/or in one surface of the mold, said grooves being supplied with parting oil or gaseous parting medium through holes in the hot top section or in the mold, and opening into the transitional area between the hot top section and the mold section. Annular gaps terminate behind the shoulder in the casting direction and are formed by annular surfaces of the hot top section, of the intermediate element and the mold section. The resultant device has a very high manufacturing cost, since matching surfaces must be manufactured very accurately on all three parts in order to keep the outlet width of the annular gap constant. Similarly, the surface parts that form the gap directly must be manufactured very precisely, and minor irregularities, for example in centering the hot top of the intermediate element and the mold, produce gap widths that are different from one another, so that the results are completely unsatisfactory because of the nonuniform supply of parting agent to the billet or casting.

SUMMARY OF THE INVENTION

The present invention provides an improved device of the aforementioned type in which the production of release agent supply channels of a more precise cross section can be accomplished with simple, inexpensive means. The solution involves providing an intermediate element in the form of a thin flat plate, and by forming at least the end sections of the supply channels which run to the opening edge of the plate by machining, etching or otherwise precisely forming them into the surface of the intermediate element and/or the top of the mold section to a constant or uniform depth. According to the present invention, a photochemical etching process or a laser-cutting process may also be used. In this manner, channels of constant uniform depth and precisely-maintainable channel cross section can be manufactured by simple means and with great accuracy. Preferably the etching and laser cutting of the channels are done on the surfaces of the intermediate element. Optionally, the invention includes the etching or laser cutting of suitable channels in the surface of the mold section, which is likewise made of metal. The relatively flexible design of the intermediate element as a thin-walled plate allows conformity with the adjacent surfaces of the hot top and the mold without the channel depths being significantly altered as a result. Usually the channel width will be uniform or constant, so that flow resistance is optimized for a constant channel cross section. It is also possible for the end sections of the channels to be tapered nozzlewise or outwardly, producing an increased escape velocity. Stainless steel or copper alloys are preferred materials for the intermediate plate since they are very suitable for etching and laser cutting of the supply channels. The preferred thickness of the intermediate element is between 0.1 and 5 mm, preferably between 0.5 and 2 mm. Good machinability is ensured.

According to one embodiment of the present invention, in order to achieve the best possible mixing and homogenization of the supplied parting medium, the supply channels for the parting media are expanded nozzlewise toward the outlet or opening edge. Basically, the expansion angle can be between about 13° and 17°, preferably about 15°. It is especially advantageous in this regard for adjacent channels to be so designed that the separating ribs therebetween do not run to the opening edge but terminate at a distance of 0.5 to 2 mm from the opening edge. As a result, the supplied parting media or release agents from adjacent channels come together in front of the opening edge, thus evening out the released parting medium as a continuous layer.

In a preferred embodiment, the intermediate plate is made as a one-piece annular element in the shape of a ring or of a rectangle. However, when the shapes of the central cross sectional openings of the hot top and the mold differ from a round cross section, it is also possible to use multipartite intermediate plates consisting of individual strips that delimit the free opening cross section. According to a first alternative, the opening edge of the intermediate plate can fit flush with the wall of the mold and be open to the cross sectional opening or cavity of the mold. The end sections of the supply channels for the parting agent run essentially radially with respect to the mold cavity and the casting direction of the billet.

According to a second embodiment, the opening edge of the intermediate plate can be covered by an overhang of the hot top section, and the end sections of the supply channels can terminate in grooves in the opening edge of the intermediate element. When the cross sectional opening of the mold is set back slightly from the opening edge of the plate, an essentially codirectional flow of the parting medium is possible relative to the production direction of the casting.

The supply channels, or the opening end cross sections, consist of individual depressions or grooves running essentially perpendicularly to the opening edge of the intermediate element, said depressions preferably separated by uniform intervals from one another for a uniform distribution of the parting agent peripherally around the mold wall. To simplify the design, according to another preferred embodiment connecting sections are provided running parallel at a distance from the opening edge, likewise in the form of depressed channels or in the form of complete slots in the intermediate element, linked by connecting channels in the mold or in the hot top for supply with parting agent.

When two different parting agents are supplied, such as parting oil and gaseous parting medium, it is preferable to provide two completely separate systems of supply channels, one of them being connected with a supply source for a gaseous medium and the other with a supply source for a parting oil. This permits a simple design for the supply channels on the top side and underside of the intermediate plate. It is also favorable for supply and metering of the oil and gas mixture forms in the immediate vicinity of the mold. To ensure intensive mixing and fogging, it is also advantageous to provide supply channels on both sides of the intermediate plate in direct relationship with one another, i.e. with lateral spacings equal to one another, pairwise directly above one another on the upper side and underside of the intermediate plate. It is also advisable for the outlet opening for the gaseous parting medium to lie in the direction of the casting or billet in advance of or upstream of the outlet openings for the parting oil. Connecting channels between the individual supply channels, and/or between the connecting channels that merge together a distance from the opening edge, preferably are provided with gaskets which are fitted in grooves in the surface of the hot top section and/or the mold section.

The invention will now be described in greater detail with reference to the following drawings showing preferred embodiments.

DESCRIPTION OF THE DRAWING

FIG. 5 is a top view of an intermediate plate having a round design;

FIG. 6 is a perspective view of a section of an intermediate plate similar to that of FIG. 2, and;

DETAILED DESCRIPTION

Figure 1:
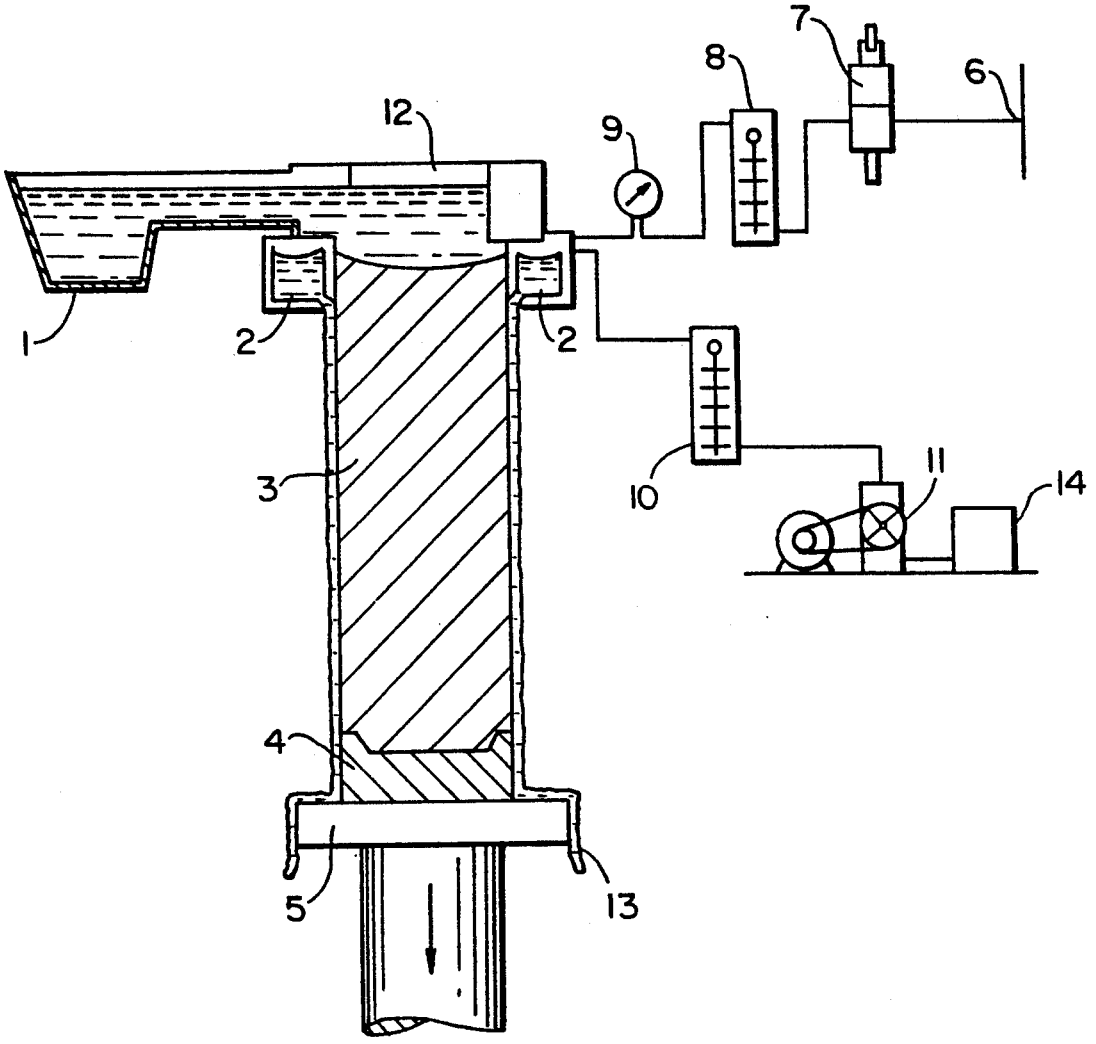
FIG. 1 is a schematic diagram of a continuous casting apparatus according to the present invention.

FIG. 1 illustrates a continuous casting apparatus having a pouring spout 1 for supplying molten metal and having a common open liquid level with a hot top 12, below which is a peripheral water-cooled mold section 2. The liquid melt cools and hardens within the peripheral mold section 2, whereupon a downwardly directed meniscus forms and hardens to form continuous ingots 3 that are supported at the bottom on a pouring floor 4, which gradually is moved downward by a table 5. At the beginning of the casting process, pouring floor 4 is at a raised position in which it essentially fits tightly into and seals the mold section 2 so that liquid metal can be added initially. The parting oil or mold release agent that escapes from the mold section is marked 13. In the intermediate area between hot top section 12 and mold section 2, a gaseous parting medium and an oil release agent are supplied. Suitable supply devices for this purpose are shown. Reference numeral 6 is an interface with a gas supply system, such as a system for supplying compressed air. Further along the line are a pressure regulator valve 7, a volume throughput or flow meter 8, and a pressure gauge 9. A reservoir 14, a pump 11 and a throughput or flow meter 10 are shown for the mold parting or release oil system. The apparatus has a shoulder or wall surrounding the hot top section 12 in the pouring direction.

Figure 2:
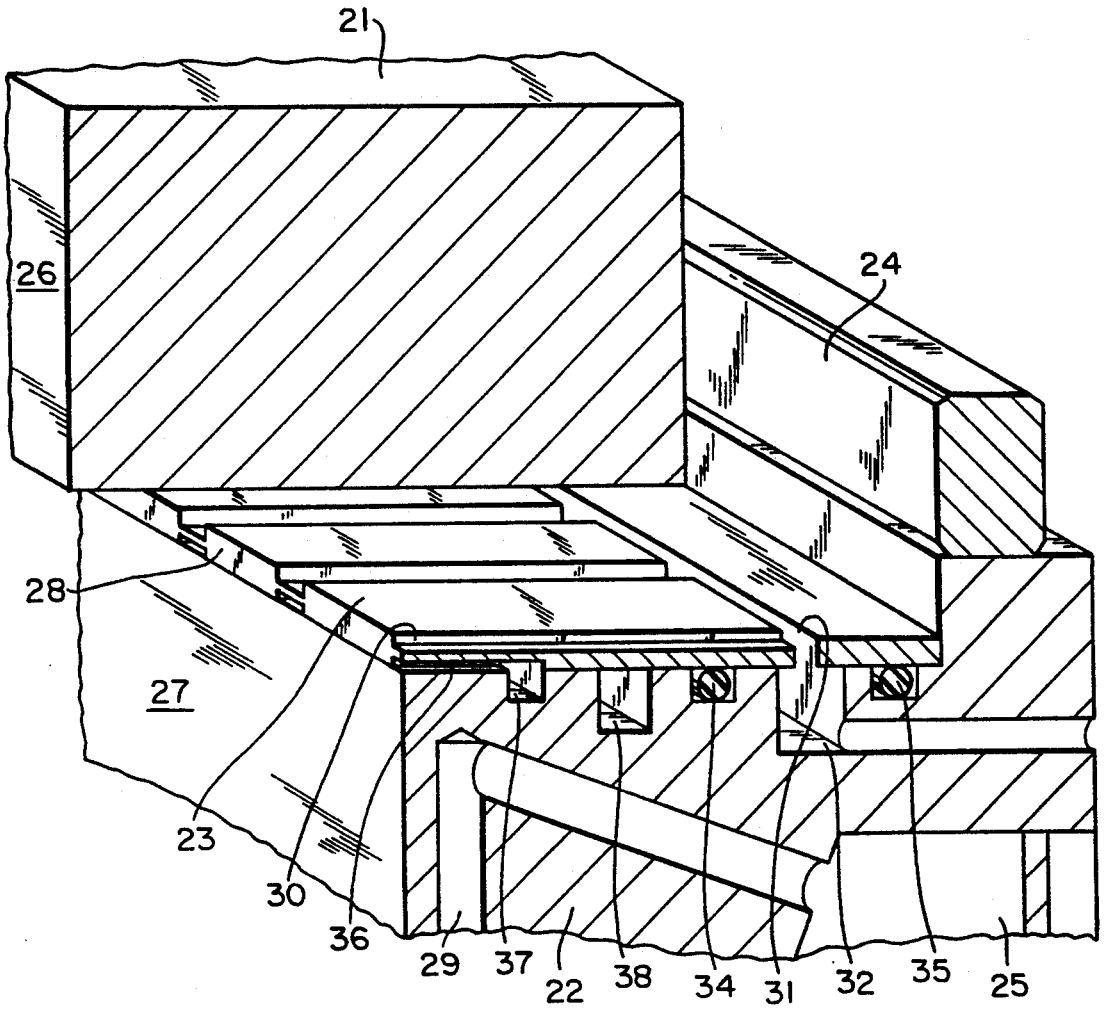
FIG. 2 is a perspective view of a graduated lengthwise section of an apparatus according to the invention.

FIG. 2 shows a hot top section 21, a mold section 22 and a thin, flat intermediate release agent supply plate or element 23 between them. The surface 26 of the hot top section extends over the free opening cross section, and the casting surface 27 of the mold is stepped back therefrom. The opening or outlet edge 28 of intermediate element 23 fits flush against and is coplanar with surface 27 of the mold. Outside the hot top is a tensioning element 24. Mold section 22 has a conventional cooling water chamber 25, and internal cooling passageways 29 are linked to cooling water chamber 25 and lead to the vicinity of the casting surface 27 of the mold section.

On the top of the intermediate supply plate or element 23, individual supply channels 30 running perpendicularly to opening edge 28 are etched at equal distances from one another and/or cut with lasers, and merged at the rear by at least one connecting channel 31, formed as a slot. Slot-shaped connecting channel 31 is located above and communicates with a supply channel 32 provided as an open groove in the surface of the mold section 22, said channel being connectable by at least one passageway 33 to a first gas or parting agent supply source. Sealing gaskets 34, 35 are fitted into grooves parallel to and closely spaced at each side of the supply channel 32.

Second supply channels 36 are etched or laser-cut in the undersurface of intermediate element 23 and are linked together by a connecting transverse channel 37 in the form of an open groove in the mold section. It is also possible in this connection to provide a transverse connecting channel partially or exclusively in the undersurface of the intermediate element 23. A supply channel to connecting channel 37 lies in a different sectional plane and is not illustrated in FIG. 2. This supply channel links channel 37 with supply channel 38 and is connected to at least one supply passageway to a gas or parting agent reservoir. Essentially the same details are visible in FIG. 2*a* as in FIG. 2, and they are marked with the same reference numerals. However, hot top section 21 has an overhand 41 that covers plate edge 28 and the mold release agent outlet openings of supply channels 30, 36 with clearance, so that they terminate in an annular groove 42 which is open at the bottom.

Figure 2A:
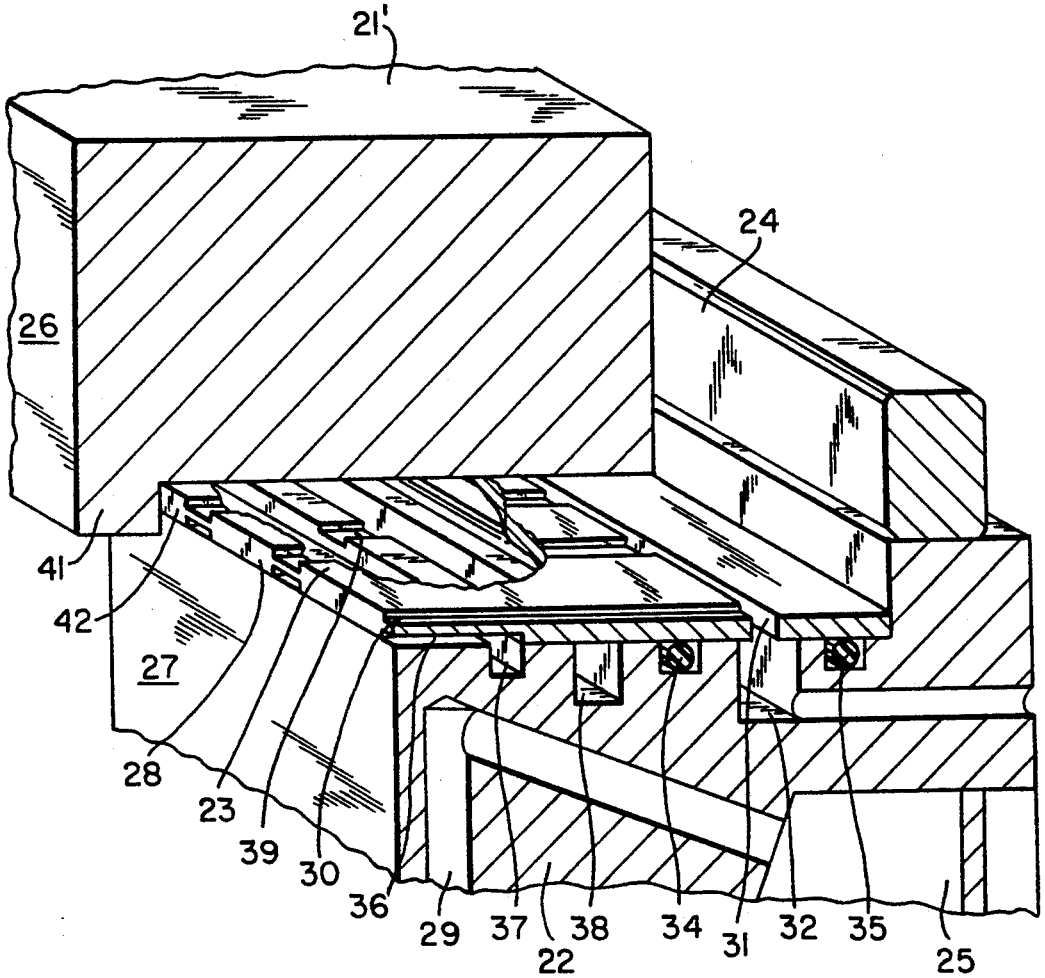
FIG. 2*a* is a perspective view of an apparatus according to the invention, similar to FIG. 2 but with an overhang for the hot top section.

Intermediate element 23 is illustrated in FIG. 2*a* with a partially cut-away surface. It is evident in this regard how supply channel 38 is connected with connecting channel 37 for the lower supply channels 36 by means of overflow slots 39 in the surface of mold 22. The other details completely correspond to those in FIG. 2.

Figure 3:
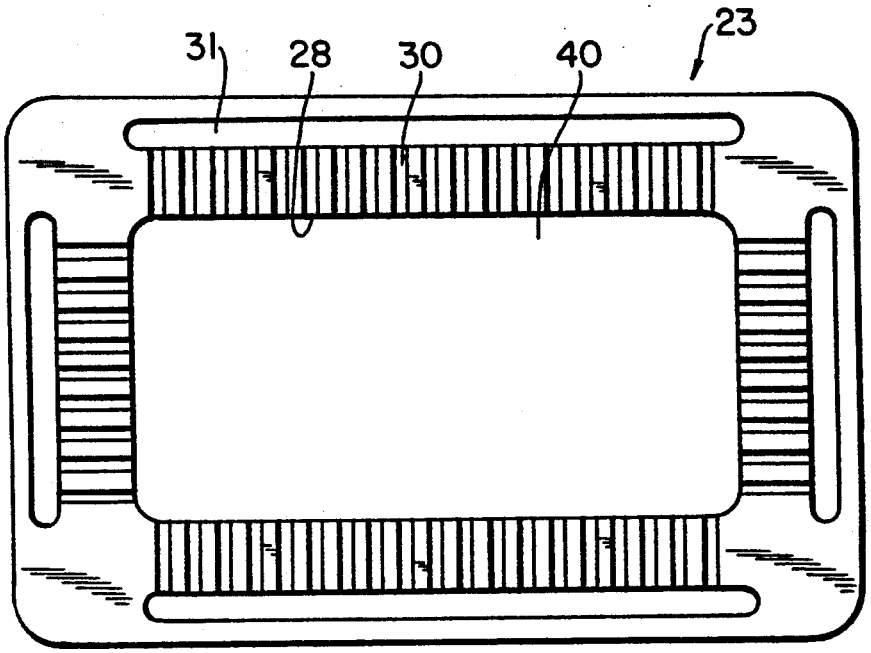
FIG. 3 is a top view of an intermediate plate of the type shown in FIG. 2.

FIG. 3 is a top view of an intermediate element 23 according to an embodiment of the invention. The central cross sectional opening 40, not previously mentioned, is illustrated and, in this embodiment has an essentially-rectangular cross section corresponding to that of the vertical mold cavity. Perpendicular to opening edge 28 are the etched and laser-cut supply channels 30, distributed around the circumference at essentially equal intervals, said channels being connected by the individual rear slot-shaped connecting channels 31. Each of connecting channels 31 requires a separate supply passageway 32 in the mold section 22 or hot top section 23, as shown in FIGS. 2 and 2*a*.

Figure 4:
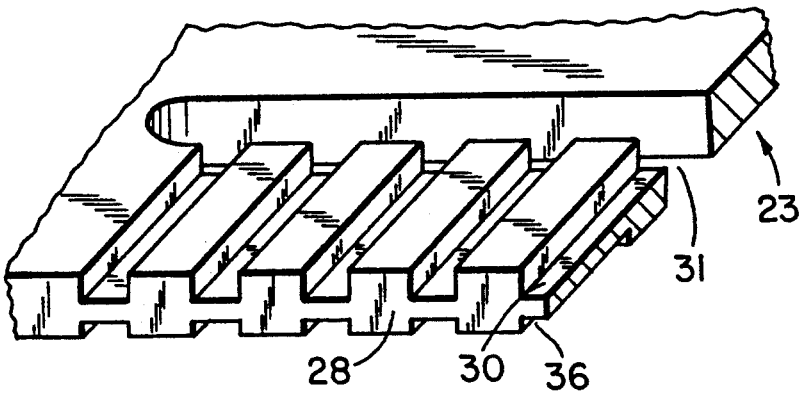
FIG. 4 is a perspective view of a section of an intermediate plate of the type shown in FIG. 2.

FIG. 4 shows more details of intermediate element 23, with reference to the description of FIG. 2.

FIG. 5 illustrates an intermediate supply plate or element 23' that is completely round or annular and hence forms a circular cross sectional opening 40'. Etched or laser-cut supply channels 30' are distributed radially around the circumference at essentially equal intervals and terminate perpendicularly to opening edge 28'. These channels are connected together by individual slot-shaped partially circular or arcuate connecting channels 31'. Each connecting channel 31' requires a separate supply passageway in the mold or in the hot top, and their function corresponds to the description for FIG. 3.

FIG. 6 shows further details of an intermediate element 23'' having a straight opening edge 28'' with which supply channels 30'' and 36'' communicate. Channels 30'' communicate with one another through a connecting channel 31''. Supply channels 30'' and 36'' are tapered nozzlewise toward opening edge 28'' so that the release agents supplied therethrough escape at increased velocity or increased pressure against the outer surface of the casting metal as it is cooled and lowered in the mold, or against the hot top overhang 41 for distribution over the casting wall 27.

Figure 7:
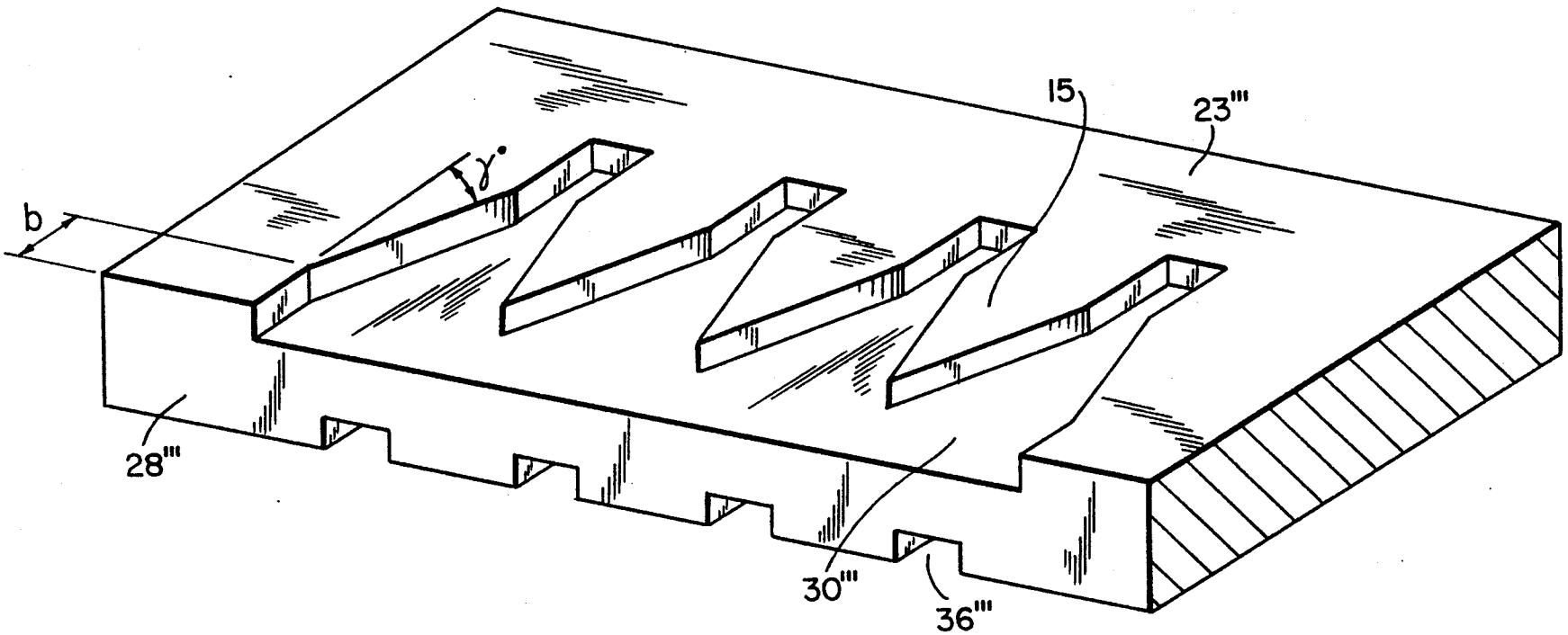
FIG. 7 is a perspective view of a section of an intermediate plate similar to that of FIG. 4 but with the supply channels expanded nozzlewise or outwardly and merging inwardly from the edge of the plate.

FIG. 7 illustrates a preferred embodiment of an intermediate release agent supply element 23''' having a straight opening edge 28''' at which supply channels 30''' and 36''' terminate. Expansion angle $\gamma°$ of nozzle-shaped supply channels 30''' is 15° in the illustrated embodiment but can be between about 13° to 17°.

Supply channels 30''' are designed so that the separating ribs 14 located between them do not extend to the opening edge 28''' but terminate at a distance b from the opening edge. Distance b can be between 0.5 and 2 mm, permitting leveling or unification before the supplied release agents escape as a continuous layer over the vertical mold surface.

It is to be understood that the above described embodiments of the invention are illustrative only, and that modifications thereof may occur to those skilled in the art. Accordingly, this invention is not to be regarded as limited to the embodiments disclosed herein, but is to be limited only as defined by the appended claims.

We claim:

1. Continuous casting apparatus comprising an upper hot top section opening into a peripheral mold section having a central mold cavity surrounded by a casting wall, supply means for feeding a continuous supply of molten casting metal to said hot top section and into said mold cavity, means for supplying at least one mold parting agent to the surface of the casting wall of the mold cavity, means for cooling said mold casting surface, sufficiently to solidify the molten casting metal fed into said mold cavity, and means for withdrawing a continuous ingot of the solidified casting metal, characterized by said means for supplying at least one mold parting agent comprising a thin, flat intermediate plate (23) which is interposed between said hot top section and said mold section, said plate having upper and lower surfaces, an opening edge (28) aligned with the casting wall of the mold cavity and having supply channels (30,36) formed to a uniform depth into said upper and lower plate surfaces and which open to said opening edge (28) to provide, in association with the adjoining surfaces of the hot top section and the mold section, a plurality of parting agent supply passages for supplying at least one release agent to the surface of the casting wall in the mold cavity.

2. Apparatus according to claim 1 characterized by the opening edge (28) of the intermediate plate (23) being flush or coplanar with the casting wall (27) of the mold section (22) and opening into the mold cavity.

3. Apparatus according to claim 1 characterized by the opening edge (28) of the intermediate plate (23) being covered by an overhang of the hot top section (21) spaced outwardly therefrom, the outlets of the supply channels (30) terminating in a groove (42) formed by said overhang and opening downwardly onto the casting wall (27) of the mold cavity.

4. Apparatus according to claim 1 characterized by the supply channels (30,36) having individual end sections running perpendicularly to the opening edge (28), said end sections being tapered inwardly, toward the opening edge (28).

5. Apparatus according to claim 1, characterized by the supply channels (30) for the release agent being expanded nozzlewise toward the opening edge (28).

6. Apparatus according to claim 1 characterized by separating ribs (15) running between the supply channels (30) terminating at a distance b from the opening edge (28).

7. Apparatus according to claim 6 characterized by the distance b from the opening edge (28) being between 0.5 and 2 mm.

8. Apparatus according to claim 5 characterized by the expansion angle $\gamma°$ of the supply channels (30), expanded nozzlewise, being between 13° and 17°.

9. Apparatus according to claim 1 characterized by the supply channels (30) being connected by connecting channels (31) in the form of slots or cutouts in the intermediate plate (23) and running parallel to and spaced inwardly from the opening edge (28), said channels being connected to supply channels (32) in the hot top section (21) or in the mold section (22).

10. Apparatus according to claim 1 characterized by the supply channels (36) being connected together by transverse connecting channels (37) running at a distance from the opening edge, said channels being formed as grooves in the surface of the mold section (22), which in turn are connected with supply channels (38) in the mold section (22).

11. Apparatus according to claim 1 characterized by two separate systems of the supply channels (30,36) being provided, one of which is connected with a supply source for a gaseous release agent and the other with a supply source for an oil release agent.

12. Apparatus according to claim 11 characterized by the outward openings of the two systems being located, one upstream of the other.

13. Apparatus according to claim 11 characterized by the outlet openings for the gaseous release agent lying upstream of the outlet openings for the oil release agent.

14. Apparatus according to claim 11 characterized by gaskets (34,35) recessed into the upper surface of the mold section (22) between the supply channels (32,38) and the supply channels (30,36) of the two systems, and running parallel thereto.

15. Apparatus according to claim 1 characterized by the intermediate plate (23) being round or rectangular.

16. Apparatus according to claim 1 characterized by the thickness of the intermediate plate being between about 0.1 and 5 mm.

17. Apparatus according to claim 16 characterized by the thickness of the intermediate plate being between about 0.5 and 2 mm.

18. Apparatus according to claim 15 characterized by the intermediate plate being multipartite.

* * * * *